US008710339B2

(12) United States Patent
Adams

(10) Patent No.: US 8,710,339 B2
(45) Date of Patent: Apr. 29, 2014

(54) TUNING PEG FOR A STRINGED INSTRUMENT

(75) Inventor: Christopher Adams, Hamburg (DE)

(73) Assignee: Goodbuy Corporation S.A., Vaduz (LI)

( * ) Notice: Subject to any disclaimer, the term of this patent is extended or adjusted under 35 U.S.C. 154(b) by 0 days.

(21) Appl. No.: 13/636,788

(22) PCT Filed: Mar. 24, 2011

(86) PCT No.: PCT/EP2011/054570

§ 371 (c)(1),
(2), (4) Date: Sep. 24, 2012

(87) PCT Pub. No.: WO2011/117367

PCT Pub. Date: Sep. 29, 2011

(65) Prior Publication Data

US 2013/0008297 A1 Jan. 10, 2013

(30) Foreign Application Priority Data

Mar. 24, 2010 (EP) ..... 10157648

(51) Int. Cl.
*G10D 3/14* (2006.01)

(52) U.S. Cl.
USPC ..... 84/304

(58) Field of Classification Search
USPC ..... 84/290, 304–306
See application file for complete search history.

(56) References Cited

U.S. PATENT DOCUMENTS

| | | | | |
|---|---|---|---|---|
| 532,053 | A | 1/1895 | Hafter et al. | |
| 4,748,889 | A * | 6/1988 | Schaller | 84/304 |
| 5,103,708 | A * | 4/1992 | Steinberger | 84/304 |
| 2002/0148342 | A1 * | 10/2002 | Kang | 84/304 |

FOREIGN PATENT DOCUMENTS

DE 102005014625 10/2006

* cited by examiner

*Primary Examiner* — Kimberly Lockett
(74) *Attorney, Agent, or Firm* — Sand & Sebolt

(57) ABSTRACT

A tuning peg for a stringed instrument, in particular a guitar, having a winding section on which a string runs and a fastening means for fixing a free end of the string. To this end, a tuning peg according to the invention comprises a clamping element and, on the tuning peg, an abutment section and a retaining section. The retaining section and clamping element are set up such that the clamping element is displaced axially on the tuning peg along the retaining section and locked in a clamping position. The clamping element and abutment section are set up such that that they clamp and retain a longitudinal section of the free end of the string between them.

9 Claims, 4 Drawing Sheets

TUNING PEG FOR A STRINGED INSTRUMENT

TECHNICAL FIELD

The present invention relates to a tuning peg for a stringed instrument and to a stringed instrument equipped with a tuning peg according to the invention.

Tuning pegs in the case of stringed instruments refer to the rotating wooden pegs or metal pins on which the string ends are rolled up. These pegs can be used to modify the tension of the strings and thereby tune the instrument. For example, on guitars or violins, these tuning pegs are arranged on the so-called heads. In the case of modern guitars, the tuning pegs can be adjusted with proper handling through gear stages in order to be able to carry out fine tuning.

Tuning pegs are thus shafts, in the technical sense, on which a string end is wound in order to tighten the string and thereby raise the tuning, or unwound in order to loosen the string and thereby lower the tuning.

PRIOR ART

In order to fix a string to a tuning peg, the tuning peg typically features a continuous bore hole or a slot in a winding section through which the string end can be passed and subsequently fixed with a knot or loops. This method of fixing a string end on the tuning peg is complicated to achieve, and there is a risk that the string end will come loose or give way, thereby detuning the instrument, especially if the process is not carried out properly. Furthermore, the knot or similar wound structure for fixing the string end takes up a considerable amount of space so that the space required for tuning pegs is comparatively large.

The aforementioned disadvantages affect, in particular, those tuning pegs that are motor-driven and adjust the string tension as a component in an automatic tuning system. Here in particular, the high stability of the fixed string is essential in order to achieve a reproducible tuning of the instrument. The most uniform possible winding of the string end on the tuning peg is also advantageous for a motor-driven adjustment, which is very difficult to achieve in the case of a knot or similar loops arranged on one side of a tuning peg, since the string consistently runs over the raised area created by the knot or loop.

Furthermore, there have been attempts in the prior art to fix the string ends by selectively clamping the string onto a tuning peg at a specific point, for example by running a clamping mandrel to a point on the string and inserting the string between the clamping mandrel and a abutment. In so doing, it has been shown that not only were the forces needed to provide a secure grip substantial, but that the risk of breaking or tearing the string at the clamping point is also substantial due, in particular, to the high forces and the selective exertion of those forces on the string at a specific point. If the string tears or breaks while the instrument is being played, playing must be interrupted and a new string put on and tuned before playing can be resumed. In addition to the considerable cost incurred for a new instrument string, this is also a nuisance which represents a clear disadvantage to such attempts to fix the string in place.

SUMMARY OF THE INVENTION

The present invention remedies this, and represents a possibility for fixing a string end to a tuning peg or of such a tuning peg itself, which allows for the secure and non-slip fixing of the string end with little effort, and which considerably reduces excessively high stress on the string end and thus the risk of breaking or tearing the string with respect to prior art.

This object is achieved by a tuning peg for a stringed instrument with the characterizing features of a winding section on which a string runs, and a fastening means for fixing a free end of the string wherein the fastening means comprises a clamping element, an abutment section on the tuning peg, and a retaining section on the tuning peg, wherein the retaining section and the clamping element are set up in such a way that the clamping element is displaced axially on the tuning peg along the retaining section and locked in a clamping position, and wherein the clamping element and the abutment section are set up in such a way that they clamp and retain a longitudinal section of the free end of the string between one another. Along with the invention, an advantageous further embodiment is provided in the form of a stringed instrument that features a novel tuning peg.

A tuning peg for a stringed instrument that can be used in the inventive manner in particular for a guitar, but also for other stringed instruments, features a winding section, on which the string runs, as well as a fastening means for fixing a free end of the string. The fastening means according to the invention comprises a clamping element, an abutment section on the tuning peg and a retaining section on the tuning peg. At the same time, the retaining section and the clamping element are set up in such a way that the clamping element can be displaced axially on the tuning peg along the retaining section and locked in a clamping position. Furthermore, the clamping element and abutment section are set up in such a way that that they can clamp and retain a longitudinal section of the free end of the string between one another. A longitudinal section of the free end of the string is understood to be an extended section that has a significant length dimension and as such, differs from a piece of the string that is only selectively clamped at certain points.

With a tuning peg designed in a manner according to the invention, the end of a string that is to be fixed therein and adjusted in terms of its tension and tuning can not only be easily fixed, whereby a corresponding longitudinal section of the free end of the string is arranged on the abutment section and clamped there by means of a clamping element that can be displaced on the tuning peg along the retaining section. In so doing, the string end can be clamped with a high degree of positional precision and stability so that unlike traditional methods, there is no risk that the knot will yield or that the attachment will come loose and therefore there will be no resulting detuning of the string fixed there. Due to the fact that the string is clamped along a longitudinal section, and thus a section of the string's length that is significantly different than what is selectively clamped at a single point is clamped between the abutment section and the clamping element, the clamping forces are distributed along a greater area of the string. As a result, there are no load peaks, so there is no associated risk of breaking or tearing a string.

A circumferential collar in particular, is suitable as an abutment section. This circumferential collar extends around the axis of the tuning peg and serves as a support for a section of the string end that is routed around a substantial portion of the circumference (up to nearly 360°) of the axis of the tuning peg, and this entire length of string can then be clamped my means of the clamping element. Therefore, in the event that the installation space is very small, such a circumferential collar also offers the possibility of clamping the string end over a substantial length, and thus distributing the clamping forces over a wider section of the string. In addition to the aforementioned reduction of load peaks, this also results in an improved grip, since clamping, and therefore the clamping and frictional forces, is distributed over a greater section of the string.

A circumferential collar within the meaning of this solution, is also understood as a collar that is intermittently interrupted along the circumference of the tuning peg, for example featuring one or more recesses. Such a recess can be used, for example, to pass the end of the string from one side of the collar, on which, for example, the winding section may be situated to the opposite side, where the collar features the abutment surface and on which, for example, the retaining section may be situated without having to make an especially sharp bend in the string when passing the same over the edge of the collar. Comparatively gently curved radii can be formed when passing the string end from one side of the collar, through a recess as a duct, through to the winding section, which, in turn, benefits the durability of the string, in which acute angular directional changes always constitute a weak point, especially if there is friction due to the vibrating string.

According to a further advantageous embodiment of the invention, the retaining section may be an externally threaded section of the tuning peg and the clamping element may be a screw element with internal thread that corresponds to the aforementioned external thread. A solution of this kind makes the tuner especially easy to use, and in addition, a suitable selection of the thread pitch and the remaining design aspects of the external and internal thread can securely lock the external thread and the internal thread in position, in which the clamping element presses against the string adjacent to the abutment and holds it on the basis of the clamping force.

It is particularly advantageous if the externally threaded section is arranged on a free end of the tuning peg in such a way that the screw element can be screwed onto the externally threaded retaining section such that it is completely removable from the tuning peg. This type of design allows for the particularly easy replacement and maintenance of parts. Naturally, it is also possible to design the screw element in such a way that it cannot be detached, or at least easily detached, from the externally threaded section of the tuning peg, for example in order to avoid the loss of the threaded clamping element should that element be inadvertently opened too far.

The screw is advantageously equipped with a knob section for easier handling, which, in particular, can be designed having a serrated, knurled or otherwise structured as a circumferential section having an otherwise profiled structure. Such knurled screws or screw elements that are otherwise provided with a grip profile simplify handling without the use of any tools.

BRIEF DESCRIPTION OF THE DRAWINGS

Further advantages and characterizing features of the invention will become apparent from the following description of an embodiment with reference to the accompanying figures. Shown are as follows:

FIG. 1*a* shows a side view; FIG. 1*b* shows the front of the view of the right side of FIG. 1*a*; FIG. 1*c* shows an additional side view in relation to the former side view, rotated by 90° around the longitudinal axis of the tuning peg; and FIG. 1*d* shows a three-dimensional representation;

MODE(S) OF IMPLEMENTING THE INVENTION

The figures show an embodiment of a tuning peg according to the invention that is a tuning peg for a guitar and, in particular, an electric guitar. The figures shown are purely schematic and do not represent complete structural design drawings. They serve merely to explain and describe an embodiment in order to further illustrate the invention.

Figure 1:
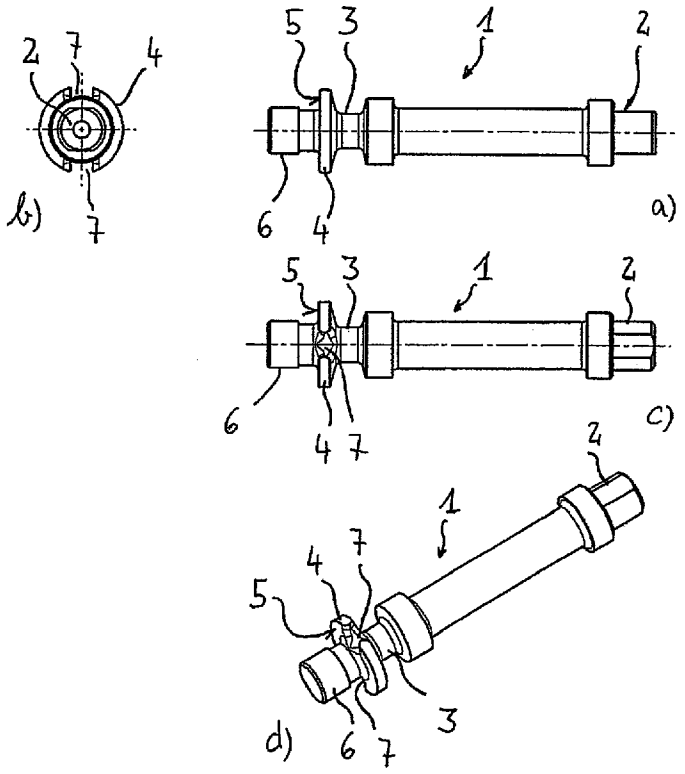
FIGS. 1*a* to *d* show four different views of a first embodiment of a tuning peg according to the invention.

FIGS. 1 *a* to 1 *d* show four views of a tuning peg according to the invention without showing the clamping element that is a part of the fastening means for fixing the end of a string of a musical instrument. The tuning peg 1 is an elongated part that is, in technical terms, a shaft. On one of its longitudinal ends, it features a connecting section 2 for connecting the same to an adjustment mechanism, for example a manually driven gear for the rotational adjustment of the tuning peg 1.

Moreover, the tuning peg 1 features a winding section 3 onto which a string of the musical instrument can be wound, or from which this string can be unwound in order to increase or decrease the string's tension and thereby adjust the tuning of the string. On the side opposite to the connecting section 2, the winding section 3 is delimited by a circumferential collar 4, which constitutes, on the one hand, a lateral arrestor for the string and thereby delimits the winding section 3, but which also constitutes, on the other hand, an abutment surface 5 that is opposite to the winding section 3, the function of which will be explained below. Moreover, a retaining section 6 follows the side of the collar 4 that is opposite the winding section 3, which forms the free end of the tuning peg 1 opposite the connecting section 2. The retaining section 6 features an external thread (not described herein in greater detail), which works in conjunction with the internal thread of a clamping element in a manner that will be described below.

The collar 4 also features radially opposing recesses 7, in which the collar 4 is cut out to the diameter of the winding section. These recesses 7 serve as a duct for routing a string or the end of a string end from the winding section 3 to the abutment surface 5, which is on the opposite side of the collar 4 in relation to the winding section 3.

Figure 2:
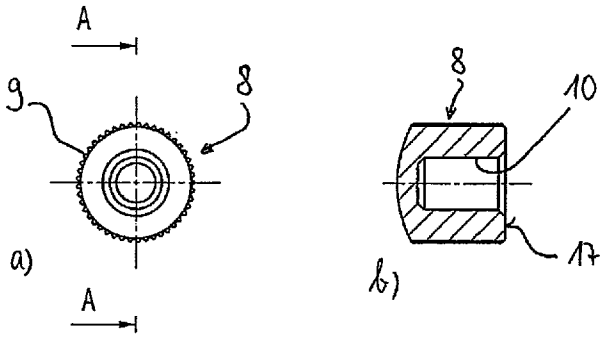
FIGS. 2*a* and *b* show two different views of a clamping screw that interacts with the tuning peg according to FIG. 1 to constitute the device for fixing the second end in place.

FIG. 2 shows a clamping screw 8 that acts as a clamping element. This clamping screw is essentially cylindrical and features knurling 9 on its circumferential surface, which forms the knob section of the clamping screw 8. This knurling 9 improves the grip and allows the clamping screw 8 to be easily operated using two fingers of one hand.

As can be seen, in particular, in FIG. 2*b*, the clamping screw 8 features an internal thread (not represented herein in greater detail), which is designated by reference number 10. This internal thread is designed to correspond to the external thread formed on the retaining section 6 of the tuning peg 1, and can be interlocked with the latter in order to screw the clamping screw 8 onto the free end of the tuning peg 1 with the retaining section 6. In this way, the clamping screw 8 can be screwed up and down the tuning peg 1 in an axial direction, in particular with a clamping surface 17 pressed against the abutment surface 5.

Figure 3:
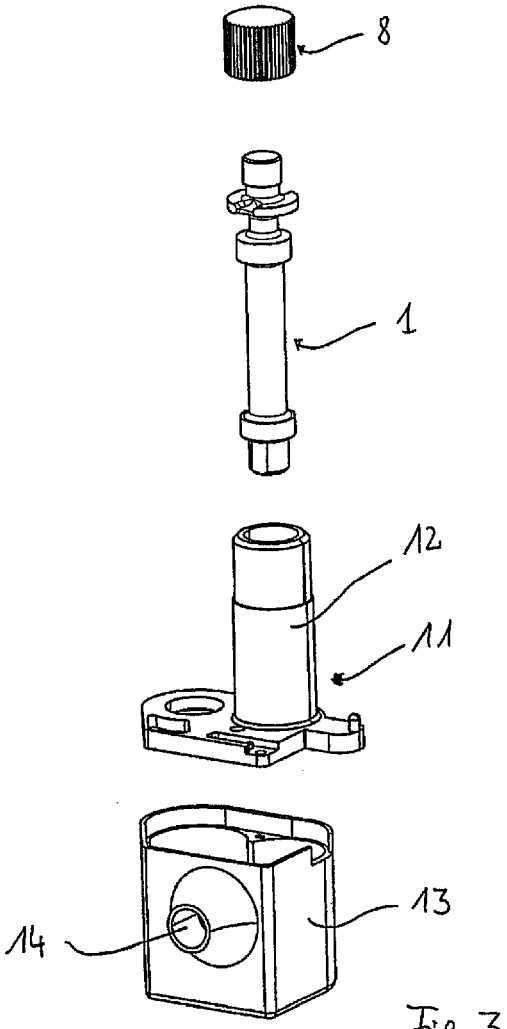
FIG. 3 shows an exploded view of the tuning peg according to FIG. 1 with the clamping screw according to FIG. 2 and two housing components provided for this embodiment.

FIG. 3 shows an exploded view of an assembly of the tuning peg 1 with the clamping screw 8, and a gear housing in which the tuning peg 1 is inserted. The gear housing consists of a guide 11 with a molded housing cover and a housing component 13, in which the gear units are arranged. The guide 11 features a guide sleeve 12, in which the tuning peg 1 is mounted such that it can be rotated. An opening 14 is arranged in the housing component 13, through which a gear shaft can be inserted, for example, with a hand screw for manually adjusting the angle of rotation of the tuning peg 1.

The configuration shown here is set up, in particular, for the motor-driven adjustment of the tuning peg 1, to which end, a motor or a gear unit can be arranged in the housing component 13.

Figure 4:
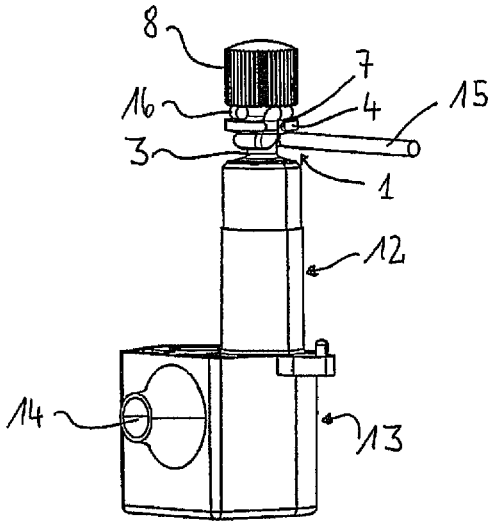
FIG. 4 shows an assembled view of the unit that was presented in an exploded view in FIG. 3, with a string end that is wound around the tuning peg and fixed in place in the clamping device according to the invention.

FIG. 4 finally shows the assembly of the parts shown in the exploded view in FIG. 3, and it shows how a string 15 runs on the winding section 3 and is fixed in place using the fastening means at one free end 16 in the manner according to the invention. The string 15 runs, as previously noted, on the winding section 3, its free end is inserted and routed through the recess 7 in the collar 4, and is wrapped nearly 360° around the abutment surface of the collar 4. The clamping screw 8 is screwed onto the retaining section of the tuning peg 1, and its clamping surface presses against the free end 16 of the string 15, thus clamping this free end 16 in place against the abutment surface of the collar 4.

The free end 16 of the string 15 can thereby be manually fixed in place on the tuning peg 1 quickly and easily. It is only necessary to arrange the free end 16 on the abutment surface 5 of the collar 4 and to screw the clamping screw 8 in the direction of the collar 4 and its abutment surface 5, thereby clamping the free end 16 of the string 15 between the abutment surface 5 and the clamping surface 17. As can be seen from FIG. 4, clamping involves a substantial, longitudinal section of the free end 16 of the string 15 in such a way that the force is distributed over an extended area of the string 15 and not, as is known from prior art, at a discrete point. This substantially reduces the risk of breaking or tearing the string. Moreover it can be seen that the radii around which the free end 16 of the string 15 must be bent in order to run this free end 16 through the recess 7 in the collar 4, on the one hand, and place it on the abutment surface 5 of the collar 4, on the other hand, are comparatively large, meaning that, there are no high stress loads on the string 15.

LIST OF REFERENCE SYMBOLS

1 tuning peg
2 connecting section
3 winding section
4 collar
5 abutment surface
6 retaining section
7 recess
8 clamping screw
9 knurling
10 internal thread
11 guide
12 guide jacket
13 housing component
14 opening
15 string
16 free end
17 clamping surface

The invention claimed is:

1. A tuning peg for a stringed instrument having a winding section on which a string runs, and a fastening means for fixing a free end of the string wherein the fastening means comprises the following elements:

i) a clamping element;

ii) an abutment section on the tuning peg, wherein the abutment section comprises a circumferential collar; and iii) a retaining section on the tuning peg;

wherein the retaining section and the clamping element are set up in such a way that the clamping element is displaced axially on the tuning peg along the retaining section and locked in a clamping position, and wherein the clamping element and the abutment section are set up in such a way that they clamp and retain a longitudinal section of the free end of the string between one another; and further comprising at least one recess in the collar for feeding-through the free end of the string.

2. The tuning peg according to claim 1, wherein seen in axial direction of the tuning peg, the winding section is located on one side of the collar and the retaining section is located on the opposite side of the collar.

3. The tuning peg according to claim 1, wherein the retaining section is a section of the tuning peg with an external thread, and the clamping element is a screw element with an internal thread corresponding to the aforementioned external thread.

4. The tuning peg according to claim 3, wherein the section provided with the external thread is disposed at a free end of the tuning peg in such a way that the screw element, completely detachable from the tuning peg is screwed onto the externally threaded section.

5. The tuning peg according to claim 3, wherein the screw element features a knob section.

6. A stringed instrument with at least one tuning peg according to claim 1.

7. The tuning peg according to claim 1, wherein the stringed instrument is a guitar.

8. The tuning peg according to claim 5 wherein the knob section has an outer circumference which is serrated or knurled.

9. The tuning peg as defined in claim 2, wherein the retaining section adjoins the collar.

* * * * *